US009994984B2

(12) United States Patent
Schwarzberger

(10) Patent No.: US 9,994,984 B2
(45) Date of Patent: Jun. 12, 2018

(54) HYBRID STANDING SIT-DOWN QUILTING APPARATUS

(71) Applicant: ABM International, Inc., The Woodlands, TX (US)

(72) Inventor: Neal A. Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 0 days. days.

(21) Appl. No.: 15/069,695

(22) Filed: Mar. 14, 2016

(65) Prior Publication Data

US 2017/0260666 A1 Sep. 14, 2017

(51) Int. Cl.
*D05B 19/12* (2006.01)
*D05B 11/00* (2006.01)
*D05B 39/00* (2006.01)

(52) U.S. Cl.
CPC ..... *D05B 19/12* (2013.01); *D05B 11/00* (2013.01); *D05B 39/00* (2013.01)

(58) Field of Classification Search
CPC ..... D05B 19/12; D05B 11/00; D05B 39/00; D05B 23/00; D05B 75/00–75/06; A47B 13/08; A47B 13/081; A47B 37/00; A47B 21/00
See application file for complete search history.

(56) References Cited

U.S. PATENT DOCUMENTS 2,958,304 A * 11/1960 Arbib ..... D05B 77/00 112/217.1
3,823,993 A * 7/1974 Kakishima ..... D05B 75/06 312/196
3,839,973 A * 10/1974 Cummins ..... D05B 33/00 112/470.12
4,056,294 A * 11/1977 Godlewski ..... D05B 75/02 112/217.1
4,503,788 A * 3/1985 Giannuzzi ..... D05B 23/00 112/470.06
4,503,789 A * 3/1985 Scholl ..... D05B 21/00 112/300
4,632,046 A * 12/1986 Barrett ..... D05B 33/00 112/304
6,631,688 B1 * 10/2003 Maag ..... D05B 11/00 112/118
6,766,747 B1 * 7/2004 Wolfe ..... A47B 13/081 108/26
7,011,031 B1 * 3/2006 Bradley ..... D05B 11/00 112/119

* cited by examiner

*Primary Examiner* — Ismael Izaguirre
(74) *Attorney, Agent, or Firm* — Timothy W. Menasco, Esq.; Harter Secrest & Emery LLP

(57) ABSTRACT

Presented is an method and apparatus. An exemplary method includes securing a moveable support surface in a first position adjacent to a sewing head having a reciprocating needle, and moving the support surface to a second position to define a working window adjacent to the sewing head. The method further includes moving the sewing head within the working window relative to the support surface in the second position.

8 Claims, 6 Drawing Sheets

HYBRID STANDING SIT-DOWN QUILTING APPARATUS

BACKGROUND OF THE INVENTION

Field of the Invention

Figure 1:
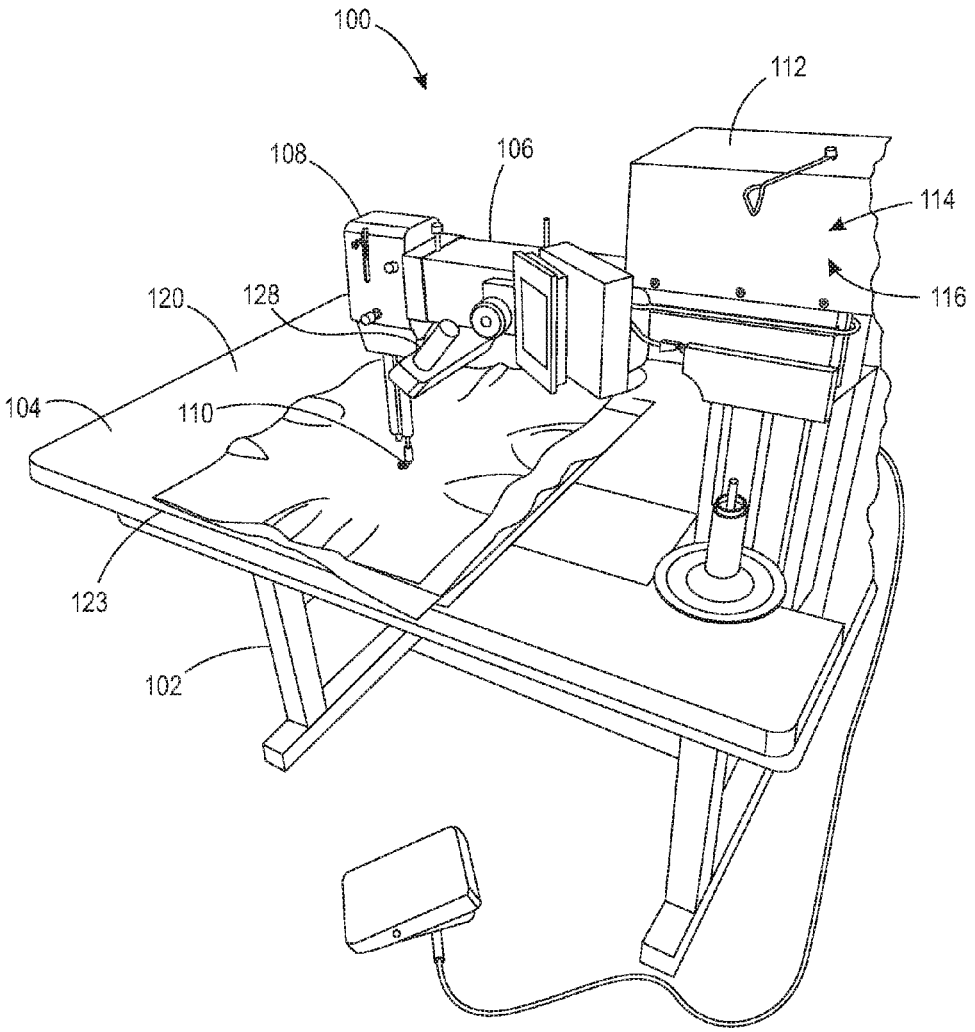

The present disclosure relates to a method and apparatus for stitching. The present disclosure relates more specifically to a method and apparatus for stitching in different positions.

Description of Related Art

A sewing machine is a machine used to stitch fabric and other materials together with thread. Home sewing machines are designed for one person to sew individual items while using a single stitch type.

Machine quilting is quilting made using a machine to stitch rows or patterns using select techniques to stitch through layers of fabric and batting in the manner of old-style hand quilting.

Free motion quilting is a process used to stitch the layers of a quilt together using a domestic sewing machine. The operator controls t the direction of the stitching by moving the quilt with their hands. The stitching can be made in any direction to produce both curvilinear lines or straight lines. Each design, whether drawn on the quilt top or held in the imagination of the quilter, is formed with a line of stitching that is guided by the movement of the quilt under the machine needle. The length of each stitch is determined by the distance the quilt has been moved since the previous stitch.

Longarm quilting is the process by which a longarm sewing machine is used to sew together a quilt top, quilt batting and quilt backing into a finished quilt. The longarm sewing machine typically ranges from 10 to 14 feet in length. Quilting using a longarm machine can take significantly less time than hand quilting or more traditional machine quilting. This time saving is a large factor in the gain in popularity of longarm quilting.

BRIEF SUMMARY OF THE INVENTION

In view of the foregoing, it is an object of the present disclosure to provide a method and apparatus for stitching.

A first exemplary embodiment of the present disclosure provides a method. The method comprises securing a moveable support surface in a first position adjacent to a sewing head having a reciprocating needle, and moving the support surface to a second position to define a working window adjacent to the sewing head. The method further comprises moving the sewing head within the working window relative to the support surface in the second position.

A second exemplary embodiment of the present disclosure provides an apparatus. The apparatus comprises a frame, and a sewing head operably connected relative to the frame, the sewing head including a reciprocating needle. The apparatus further comprises a support surface moveably connected to the frame between a first position adjacent to the sewing head and a second position spaced from the sewing head to define a working window adjacent to the sewing head.

A third exemplary embodiment of the present disclosure provides an apparatus. The apparatus comprising a frame, and a support surface coupled to the frame, the support frame having two parallel short sides and two parallel long sides. The apparatus further comprising a sewing head having a reciprocating needle, and a rail system interconnecting the support frame and the sewing, the rail system comprising two parallel short rails, one of each of the two parallel short rails fixedly coupled to the support surface along opposing edges of the short sides of the support surface, the railing system further comprising at least one long rail moveably connected to the two parallel short rails allowing movement of the at least one long rail through a long axis of the two parallel short rails, and wherein the sewing head is moveably connected to the at least one long rail allowing movement of the sewing head through the long axis of the at least one long rail.

The following will describe embodiments of the present disclosure, but it should be appreciated that the present disclosure is not limited to the described embodiments and various modifications of the disclosure are possible without departing from the basic principle. The scope of the present disclosure is therefore to be determined solely by the appended claims.

BRIEF DESCRIPTION OF THE SEVERAL VIEWS OF THE DRAWING(S)

FIG. 1 presents a perspective view of a first configuration of an exemplary quilting machine suitable for use in practicing exemplary embodiments of this disclosure.

Figure 2:
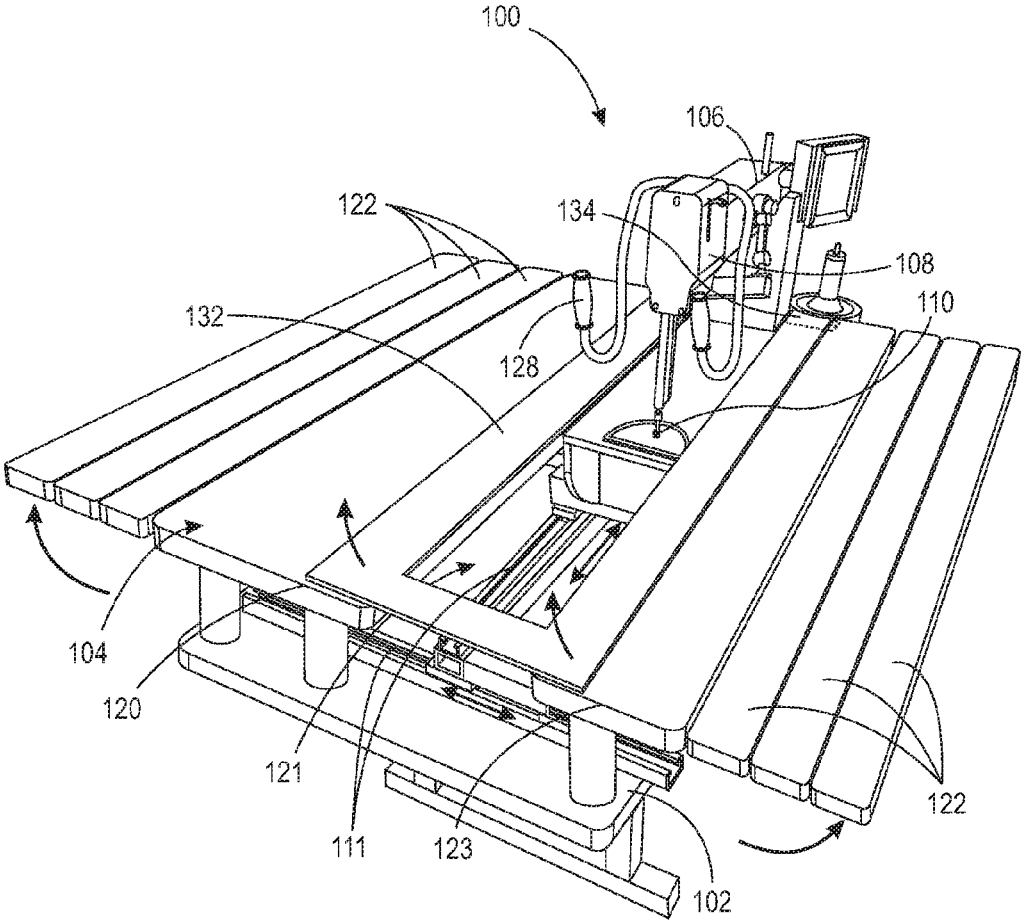

FIG. 2 presents a perspective view of a second configuration of an exemplary quilting machine suitable for use in practicing exemplary embodiments of this disclosure.

Figure 3:
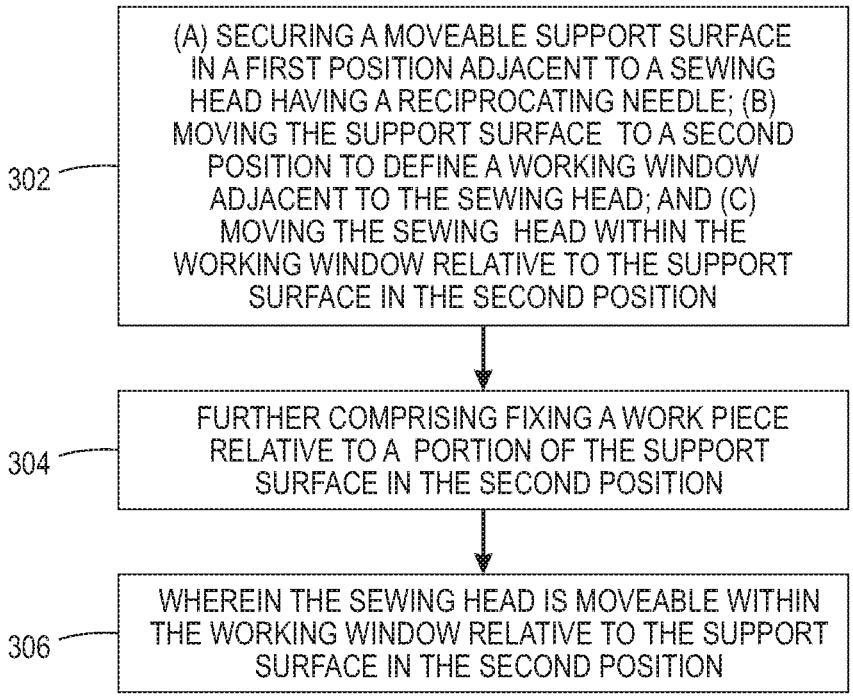

FIG. 3 presents a logic flow diagram in accordance with a method and apparatus for performing exemplary embodiments of this disclosure.

Figure 4:
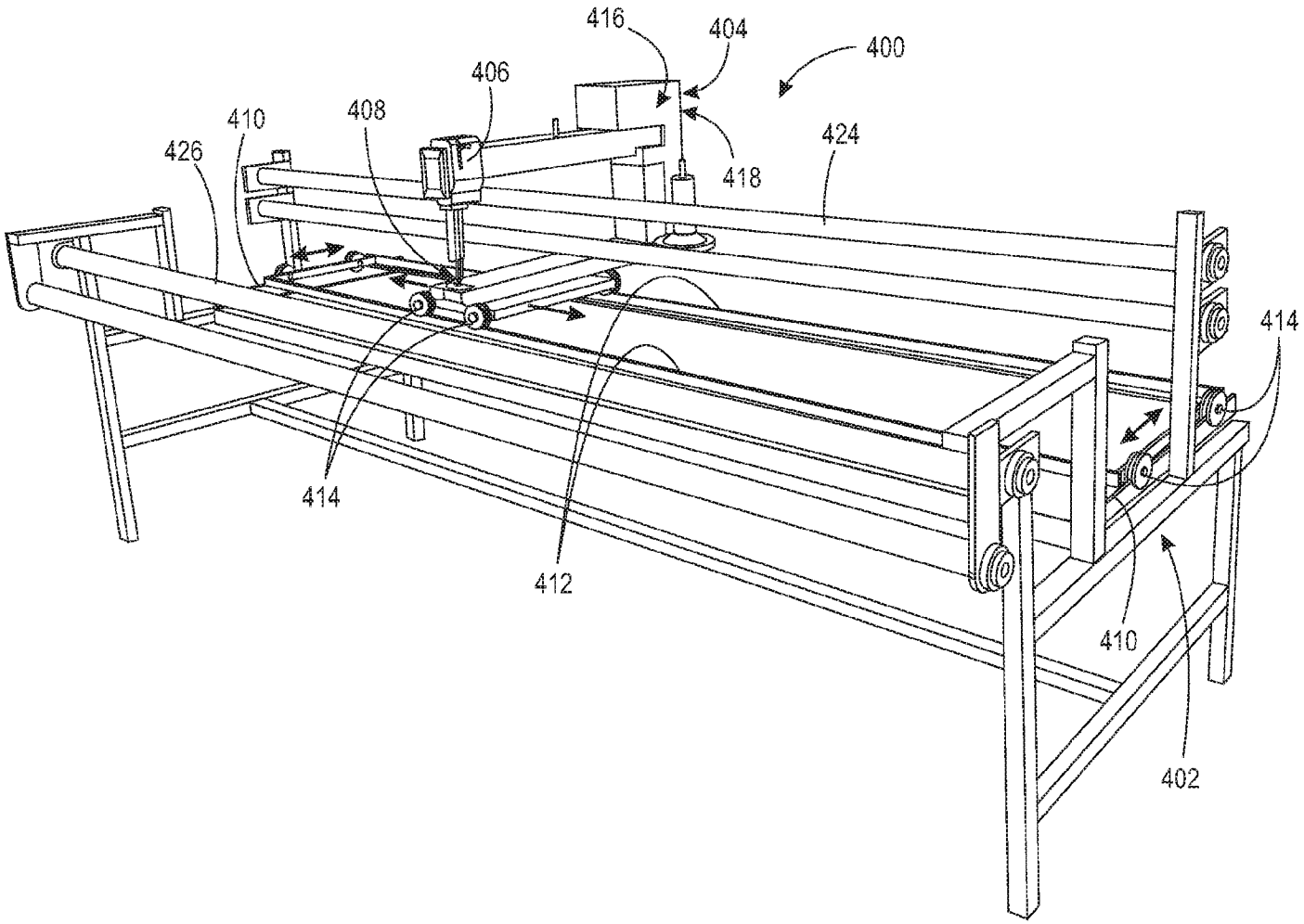

FIG. 4 presents a perspective view of an exemplary quilting machine suitable for practicing exemplary embodiments of this disclosure.

Figure 5:
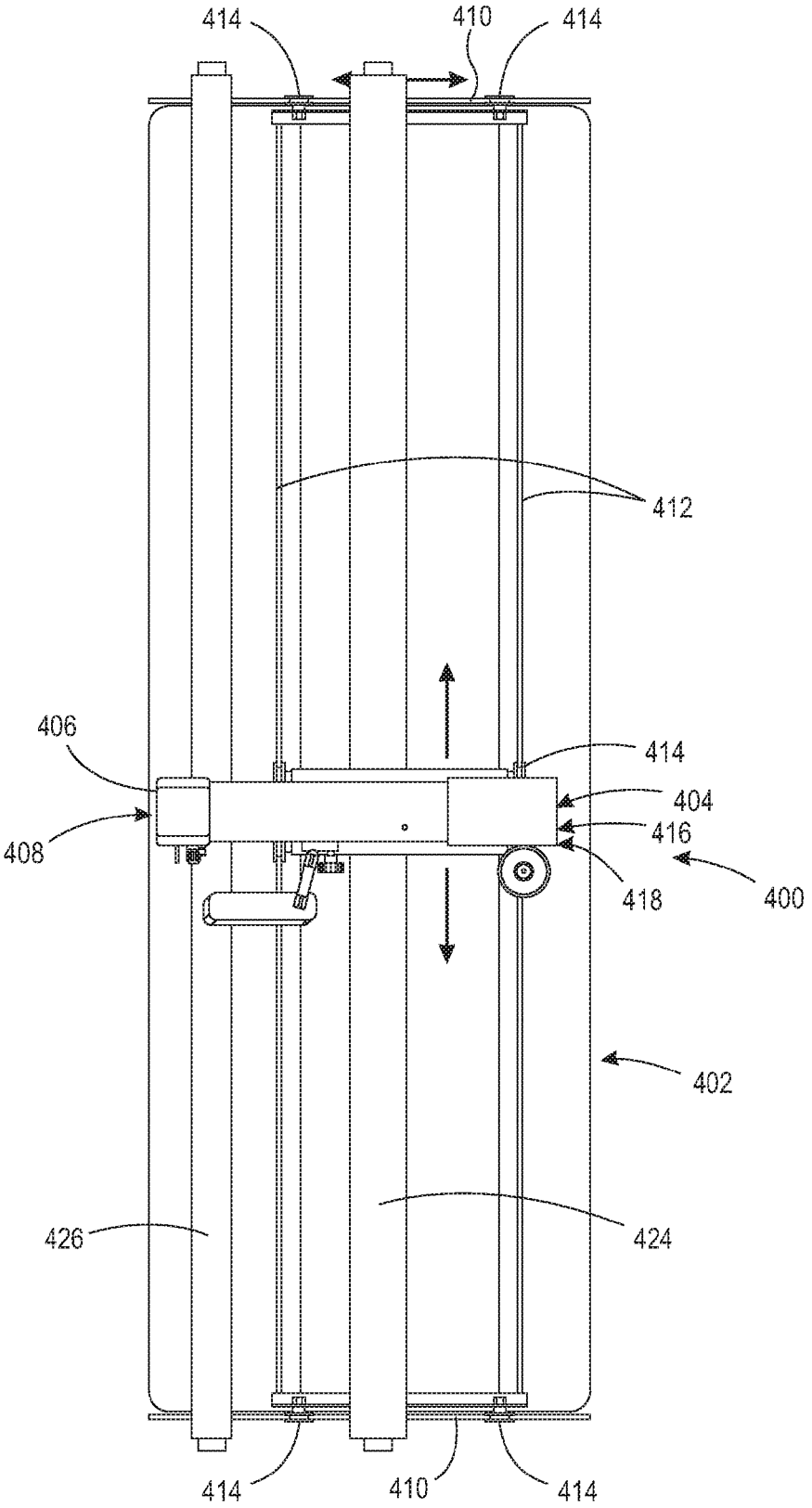

FIG. 5 presents a top view of an exemplary quilting machine suitable for practicing exemplary embodiments of this disclosure.

Figure 6:
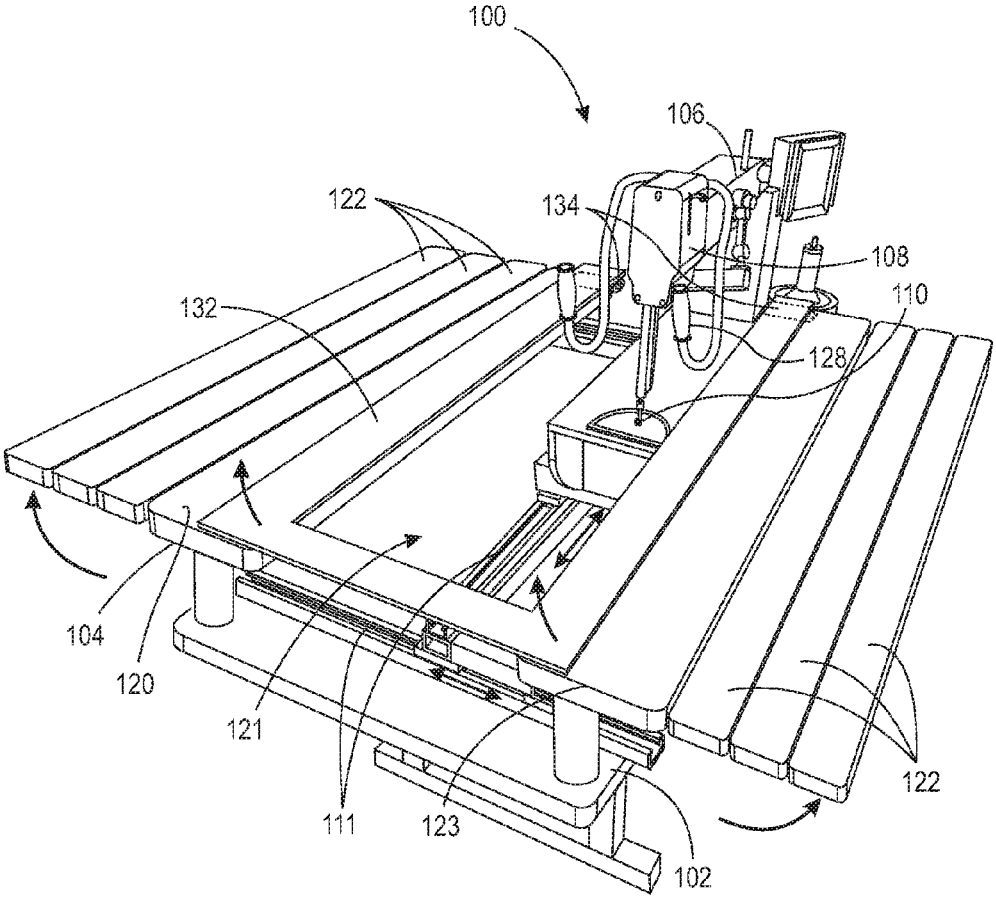

FIG. 6 presents a perspective view of the second configuration of an exemplary quilting machine with a larger working window suitable for use in practicing exemplary embodiments of this disclosure.

DETAILED DESCRIPTION OF THE INVENTION

In free motion quilting, the location as well as the movement of the needle relative to a location of a work piece is determined by a user. That is, the user moves the sewing head of the sewing machine in whichever direction they desire to create a pattern in a work piece such as a quilt. Hence, the location of each stitch in free motion quilting is determined by the user and not preprogrammed by a computer.

For a "sit-down" quilting machine, a user operates a stationary sewing head to stitch patterns or other designs into a work piece. A user moves the work piece below a reciprocating needle in order to create a desired pattern or stitching. A "sit-down" quilting machine is more favorable for smaller venues due to its compact size. A user who only has a small room to devote to quilting often finds a "sit-down" quilting machine quite appealing. However, for larger work pieces, a "sit-down" quilting machine is quite cumbersome to operate. Longarm quilting machines have the capacity to effectively stitch or quilt larger work pieces where a "sit-down" quilting machine does not. Yet, due to their size, longarm quilting machines can only effectively operate in areas or rooms that are generally larger.

Exemplary embodiments of the present disclosure provide an apparatus and method for quilting with a sewing head that can be configured to operate such that it is fixed relative to a support surface in one embodiment and in a second embodiment configured to be moveable relative to the support surface. Exemplary embodiments of the present disclosure also provide for the support surface to provide a working plane in one configuration and a working window in a second configuration.

Referring to FIG. 1, shown is a perspective view of a first configuration of an exemplary quilting machine 100 suitable for use in practicing exemplary embodiments of this disclosure. It can be appreciated that embodiments of the present disclosure are not limited to the particular configurations of quilting machine 100.

The term quilting machine 100 incorporate any device operable to stitch or embroider a work piece, fabric or quilt. The term quilting machine 100 also includes quilting machines able to stitch together multiple layers, such as a filler layer between a top and bottom textile layer, as well as an embroidery machine.

The term work piece incorporates any article of manufacture or fabric made by weaving, felting, knitting, crocheting, stitching, quilting, and compressing natural or synthetic fibers. In one configuration, the work piece is a quilt.

As depicted in FIG. 1, quilting machine 100 includes a frame 102, a support surface 104 for supporting or retaining at least a portion of a work piece or fabric, a sewing machine 106, a sewing head 108, and reciprocating needle 110. Quilting machine 100 further includes a motor 112, a controller 114 operably connected to the sewing head 108, and in some embodiments an encoder 116.

The controller 114 can include a computer processor (not shown) and memory (not shown) for storing computer program instructions. The computer program instructions when executed on the computer processor allow for quilting machine 100 to perform the operations described herein.

Frame 102 can be arranged in any variety of configurations such that it can properly maintain support surface 104, sewing machine 106 and any other items necessary for the operation of sewing machine 106. For example, frame 102 as illustrated in FIG. 1 can include struts or supports for engaging components described herein. The frame 102 can be composed of any variety of materials or combinations of materials, such as metals, metal alloys, aluminum alloys, plastics, composites or wood.

Sewing machine 106 includes sewing head 108 having a portion above support surface 104 and a second portion below or within support surface 104. A passage is provided in support surface 104 such that a portion of reciprocating needle 110 can pass through a work piece placed on top of support surface 104 and selectively engaging the passage of a length of thread through the work piece.

In some embodiments, quilting machine 100 also includes a first sensor 124 and a second sensor 126 located on support surface 104. First sensor 124 and second sensor 126, as shown in FIG. 1, are optimally located on opposite sides of the drop location of the reciprocating needle 110. The first sensor 124 and second sensor 126 include motion sensors or any type of sensor capable of monitoring the movement of a work piece relative to the sewing head 108.

An optical sensor operates by using a small camera that takes upward of 1,500 pictures every second. The images are compared with one another such that over a sequence of images it can be determined when movement occurs. An exemplary optical sensor in the marketplace is found in a commercially sold optical mouse for a computer. In other exemplary embodiments of quilting machine 100, the first sensor 124 and the second sensor 126 are located on sewing head 108 such that they can monitor the movement of the work piece relative to the sewing head 108. Thus, the sensors 124 and 126 may be located below the work piece or above the work piece on support surface 104.

Exemplary embodiments of controller 114 can include a display and input, such as a touch screen, keyboard, keypad, and/or mouse. The controller 14 can be physically connected to the support surface 104 or the sewing machine 106. Alternatively, the controller 114 can be a stand-alone device, which communicates with the sewing machine 106, motor 112, and encoder 116 through a wired or wireless connection.

Encoder 116 is operably able to communicate with the controller 114 as well as computer processor 118 and memory 120. Encoder 116 receives the movement information determined by the computer processor 118 and memory 120. Encoder 116 then translates or converts the movement information into a format readable by motor 112, such that motor 112 operates reciprocating needle 110 in a manner that maintains a uniform stitch length or the stitch length desired by a user.

Reference is now made to FIG. 2, which depicts a perspective view of a second configuration of an exemplary quilting machine suitable for use in practicing exemplary embodiments of this disclosure. Shown in FIG. 2 is quilting machine 100 with frame 102, support surface 104 with a first portion 120 and a second portion 123 in the open position, sewing machine 106, sewing head 108, reciprocating needle 110, work piece retaining frame 132, and leaves or extensions 122.

Support surface 104 provides a flat area for the work piece to be placed while sewing machine 106 is sewing or operating on the work piece. Support surface 104 includes first portion 120 and second portion 123. In another embodiment, support surface 104 further includes leaves or extensions 122. Leaves or extensions 122 are moveably coupled to support surface 104 such that they can be moved between an extended position and retracted to a compact position.

First and second portions 120, 123 are moveable relative to frame 102 between a closed position as depicted in FIG. 1 and an open position as depicted in FIG. 2. In the embodiment shown in FIG. 1, first portion 120 includes half of support surface 104 and the second portion 123 includes the other half of support surface 104. However, it should be appreciated that first portion 120 and second portion 123 need not be equal and separate portions of support surface 104, and that embodiments of this disclosure include first portion 120 and second portion 123 including different percentage surface areas of support surface 104.

In the open position, the first portion 120 and second portion 123 are laterally spaced along the plane of support surface 104 from one another such that between first portion 120 and second portions 123 is defined a working window 121. In this configuration, sewing head 108 is moveable within the working window 121 such that sewing head 108 is able to create stitches on a work piece that is placed within the working window 121. Embodiments of first portion 120 and second portions 123 are moveable between the open position and the closed position through the use of rails, slides, wheels, or combinations of all three.

In the extended position, leaves or extensions 122 provide additional surface area to the flat area of support surface 104 for a work piece to be placed. In the compact position, leaves or extensions 122 are located in a position that does not add additional surface area to the support surface 104 and allows for operation of sewing machine 106. In one embodiment, leaves or extensions 122 can moveably slide together such that they are overlapping and located underneath support surface 104 in the compact position. In the embodiment illustrated in FIG. 1, support surface 104 is shown in the compact configuration. Leaves or extensions 122 in FIG. 1 are not shown, but are located beneath support surface 104. An exemplary support surface 104 in the closed or compact configuration provides a flat area in the range of 36 inches by 48 inches. An exemplary support surface 104 in the extended position provides a flat area in the range of 36 inches by 72 inches. However, it should be appreciated that embodiments of this disclosure include a flat area that is either smaller or larger than those dimensions disclosed herein.

As shown in FIG. 2, the first portion 120, the second portion 123 and leaves or extensions 122 are in the extended position. As depicted in FIG. 2, leaves or extensions 122 include three (3) leaves or extensions 122 on the left side of support surface 104 and three (3) leaves or extensions 122 on the right side of support surface 104. However, it should be appreciated that embodiments of the present disclosure also include more or less leaves or extensions 122 as depicted in FIG. 2. In another embodiment, support surface 104 includes one or two leaves or extensions 122 that are able to foldably extend or collapse to a user's desired length.

Sewing head 108 includes reciprocating needle 110. Exemplary embodiments of reciprocating needle 110 provide that it can operably move in an up and down (or along an X-axis or Y-axis) motion along rails or tracks 111, such that a portion of reciprocating needle 110 can pierce a work piece that lies on support surface 104. In the configuration depicted in FIG. 1, sewing head 108 is stationary relative to support surface 104 and frame 102. Embodiments of the present disclosure provide that while first portion 120 and second portion 123 are in the closed position, sewing head 108 is maintained in a fixed position relative to the support surface 104 and frame 102. Thus, in the illustration shown in FIG. 1, a user that desires to stitch a work piece will move the work piece in a desired pattern while the sewing head 108 remains motionless. Embodiments further include that while first portion 120 and second portion 123 are in the open position, sewing head 108 is moveable relative to support surface 104 and frame 102 within the working window 121. Thus, in the illustration in FIG. 2, a user that desires to stitch a work piece will move the sewing head 108 in a desired pattern while the work piece remains motionless.

Work piece retaining frame 132 is rotatably affixed to support surface 104 through hinges 134 such that work piece retaining frame 132 can rotate about hinges 134 to and from a down position (as depicted in FIG. 2) and an up position. The down position, which is depicted in FIG. 2, allows work piece retaining frame 132 to be placed over a work piece on support surface 104 thereby maintaining its position relative to sewing head 108. In the up position, work piece retaining frame 132 allows a work piece to be moved and relocated such that other segments of the work piece can be stitched by sewing head 108 within working window 121.

It should be appreciated that embodiments of work piece retaining frame 132 provide that hinges 134 can be placed either on the end of support surface 104 or anywhere in the mid-section of support surface 104 allowing work piece retaining frame 132 to rotate into the up position such that a work piece on support surface 104 can be freely moved within working window 121. Exemplary embodiments of work piece retaining frame 132 include any combination of clamps, hinges, frames, and hold downs that allow a work piece to be both maintained in one configuration and moveable in a second configuration.

Embodiments of rails or tracks 111 include the use of wheels, belts, pulleys, and/or ball bearings moveable maintained within precision rails (as shown in FIG. 2) that are rotatably attached to sewing head 108 to allow sewing head 108 to move within working window 121.

Exemplary embodiments provide that encoder 116, while sewing machine 106 is in a moveable configuration, may operably track the movement of the sewing head 108 relative to support surface 104 such that motor 112 operates reciprocating needle 110 in a manner that maintains a uniform stitch length or the stitch length desired by a user.

In another exemplary embodiment, while sewing machine 106 is in the moveable configuration, motor 112, controller 114 with computer processor 118, memory 120 storing computer program instructions, and encoder 116 can automatically stitch a predetermined pattern on a work piece. In this embodiment, motor 112 controls both the movement of reciprocating needle 110 and the movement of sewing machine 106 over support surface 104.

In the configuration depicted in FIG. 2, since the first portion 120 and the second portion 123 are in the open position, a working window 121 is defined by the space between the first portion 120 and the second portion 123 in which sewing head 108 can operably move or stitch. The working window 121 provides an area on or within support surface 104 wherein a user can move and stitch with sewing head 108. In this embodiment, a user will maintain a work piece in a fixed or stationary position while moving the sewing head 108 within the working window to create a desired pattern or stitching. A work piece can be fixed relative to the support surface 104 through the use of clamps, clips, rollers, or a combination of the like.

In the configuration depicted in FIG. 2, sewing machine 106 may include handles 128 for selectively moving sewing head 108 over the working window. In this configuration, handles 128 may include one or two handles and may also include a switch or button 130 for selectively operating reciprocating needle 110. Exemplary embodiments of handles 128 are moveable between a use position and a closed position. In the use position, handles 128 can be used by a user to move and operate sewing head 108. In the closed position, handles 128 cannot be used to move or operate sewing head 108. In the closed position, handles 128 allow for unobstructed view of the work piece and reciprocating needle 110 for a user.

In one exemplary embodiment, placement of the first portion 120 and the second portion 123 into an extended position will automatically define or reveal a working window 121 and place sewing machine 106 in a moveable configuration. In another exemplary embodiment, placement of sewing machine 106 into the moveable configuration will automatically open the first portion 120 and the second portion 123 defining working window 123.

Reference is now made to FIG. 6 which depicts a perspective view of a second configuration of an exemplary quilting machine with a larger working window 121 suitable for use in practicing exemplary embodiments of this disclosure. Shown in FIG. 6 is quilting machine 100 with frame 102, support surface 104 with a first portion 120 and a second portion 123 in the open position, sewing machine 106, sewing head 108, reciprocating needle 110, rails 111, work piece retaining frame 132, and leaves or extensions 122.

Quilting machine 100 as shown in FIG. 6 operates similar to that as shown in FIG. 2, however, the working window 121 shown in FIG. 6 is larger than that shown in FIG. 2, allowing for a larger range of motion of sewing head 108. In the embodiment shown in FIG. 6, sewing head 108 is able to move along rails 111 in the X-axis and/or Y-axis directions within working window 121 to create or stitch patterns on a work piece placed on top of first portion 120 and/or second portion 123. The larger working window 121 shown in FIG. 6, allows a user to stitch or create larger patterns on a work piece without having to adjust the location of the work piece.

In one exemplary embodiment, the working window 121 as shown in FIG. 6 is 20 inches by 24 inches. In another exemplary embodiment, the working window 121 as shown in FIG. 6 is 20 inches by 12 inches. It should be appreciated that the working window 121 may be any dimension that allows for the sewing head 108 to stitch a quilt. In one embodiment, a user is able to stitch a pattern on a work piece in standard quilt blocks of 10 inches by 10 inches, 12 inches by 12 inches, and/or 18 inches by 18 inches.

FIG. 3 presents a logic flow diagram in accordance with a method and apparatus for performing exemplary embodiments of this disclosure. Block 302 presents (a) securing a moveable support surface in a first position adjacent to a sewing head having a reciprocating needle; (b) moving the support surface to a second position to define a working window adjacent to the sewing head; and (c) moving the sewing head within the working window relative to the support surface in the second position. Then block 304 specifies further comprising fixing a work piece relative to a portion of the support surface in the second position. Block 306 then states wherein the sewing head is moveable within the working window relative to the support surface in the second position.

The present system thus provides a first configuration wherein a sewing machine is fixed relative in a support surface and a second configuration wherein the sewing machine is moveable relative to the support surface, wherein the support surface in the second configuration includes a working window in which the sewing head is moveable relative to the frame.

It should be appreciated that though the embodiments depicted in FIG. 1 and FIG. 2 show a support surface 104 with a first portion 120 and a second portion 123 that in an open position define a working window 121, embodiments of this disclosure further include a support surface 104 that has 2 or more portions that are separable to create a working window for stitching.

In most longarm quilting machines, the sewing machine is moveable throughout a given area such that the sewing machine can stitch patterns on a work piece located in the given area. The more exact a user or computer can move the sewing machine, the more accurate the user or computer can stitch and create patterns on the work piece. However, most longarm quilting machines are able to "wiggle" or slightly rotate in a given location due to give between the different rails that allow the sewing machine to move throughout a given stitching area. Exemplary embodiments of the present disclosure provide a longarm quilting machine which reduces inaccuracies in moving a sewing machine throughout a given area by reducing the "wiggle" or the ability of the sewing machine to rotate in a given location.

Reference is now made to FIG. 4, which depicts a perspective view of an exemplary quilting machine suitable for practicing exemplary embodiments of this disclosure. Shown in FIG. 4 is quilting machine 400 with frame 402, sewing machine 404, sewing head 406 with reciprocating needle 408, short rails 410, long rails 412, wheels 414, motor 416, and controller 418 having a computer processor 420 (not shown) and memory 422 (not shown) storing computer program instructions.

In one configuration, quilting machine 400 includes a supply roll assembly 424 and a take up roll assembly 426 which cooperate to define a work piece retention area 428. The supply roll assembly 424 and the take up roll assembly 426 each retain a portion of a work piece such that a portion of the work piece is maintained with a certain tension optimal for stitching between the supply roll assembly 424 and the take up roll assembly 426 within the work piece retention area.

As shown in FIG. 4, sewing machine 404 is attached, sits on, or is placed on long rails 412 and indirectly short rails 410. Exemplary embodiments of short rails 412 and long rails 410 allow sewing machine 404 to move throughout the extent of the work piece retention area.

Exemplary embodiments of short rails 412 include a set of rails located on an edge of frame 402 perpendicular to the long axis of frame 402 and allow movement of sewing machine 404 through the short axis direction of frame 402 along the work piece retention area. Exemplary embodiments of the long rails 410 provide a set of rails located parallel to the long axis of frame 402 and allow movement of sewing machine 404 through the long axis direction of frame 402 along the work piece retention area.

Wheels 414 are coupled to sewing machine 404 such that sewing machine 404 can move along long rails 412 through the long axis of frame 402. In another exemplary embodiment, sewing machine 404 can slide along long rails 412 for movement of sewing machine 404 throughout the work piece retention area with or without the aid of wheels 414. It should be appreciated that exemplary embodiments of the present disclosure include a sewing machine 404 that can operably move throughout the work piece retention area along short rails 410 and long rails 412.

Exemplary embodiments of short rails 410 and long rails 412 are substantially planar elongate, strip like members, wherein the wheels 414 engage a longitude edge of short rails 410 or long rails 412. Exemplary rails can be flat, such that manufacturing costs are substantially reduced relative to prior bent or multi-thickness rails. However, exemplary embodiments of the present disclosure provide for the combination of any type of rails and wheels such that sewing machine 404 can move throughout the work piece retention area while "wiggle" or rotation of sewing machine 404 at a given location is reduced.

Referring to FIG. 5, shown is a top view of an exemplary quilting machine suitable for practicing exemplary embodiments of this disclosure. Illustrated in FIG. 5 are frame 402, long rails 412, short rails 410, and wheels 414. As shown in FIG. 5, longs rails 412 run parallel to the long axis of frame 402 and short rails 410 run parallel to the short axis of frame 402. Long rails 412 with wheels 414 provide a means for sewing machine 404 to move along the long axis of frame 402. Short rails 410 provide a means for sewing machine 404 to move along the short axis of frame 402. In the arrangement depicted in FIG. 5, a sewing machine or other device located on top of long rails 412 are prevented from or substantially prevented from "wiggling" or rotating around the vertical axis in a given position. This can aid in preventing error in the movement, change of movement or location of sewing machine 404.

The disclosure has been described in detail with particular reference to an embodiment, but it will be understood that variations and modifications can be effected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method comprising:

a) securing a moveable support surface in a first position adjacent to a sewing head having a reciprocating needle, wherein the sewing head is operable to stitch a work piece in the first position and is fixed relative to the moveable support surface in the first position;

b) moving the support surface to a second position to define a working window adjacent to the sewing head, wherein the sewing head is moveable within the working window relative to the support surface in the second position and is operable to stitch while moving throughout the working window; and c) moving the sewing head within the working window relative to the support surface in the second position.

2. The method according to claim 1, the method further comprising fixing a work piece relative to a portion of the support surface in the second position.

3. An apparatus comprising:

a) a frame;

b) a sewing head operably connected relative to the frame, the sewing head including a reciprocal needle;

c) a support surface moveably connected to the frame between a first position adjacent to the sewing head and a second position spaced from the sewing head to define a working window adjacent to the sewing head, wherein the sewing head is operable to stitch a work piece in the first position and is fixed relative to the support surface in the first position, and wherein the sewing head is moveable within the working window relative to the support surface in the second position and is operable to stitch while moving throughout the working window.

4. The apparatus according to claim 3, wherein the support surface has a first portion and a second portion, each of the first portion and the second portion moveable relative to the frame between the first position and the second position.

5. The apparatus according to claim 3, the apparatus further comprising a work piece retaining frame for releasably securing a work piece relative to the support surface.

6. An apparatus comprising:

(a) a frame;

(b) a support surface coupled to the frame, the support frame having two parallel short sides and two parallel long sides;

(c) a sewing head having a reciprocating needle; and (d) a rail system interconnecting the support frame and the sewing head, the rail system comprising two parallel short rails, one of each of the two parallel short rails fixedly coupled to the support surface along opposing edges of the short sides of the support surface, the railing system further comprising at least one long rail moveably connected to the two parallel short rails allowing movement of the at least one long rail through a long axis of the two parallel short rails, and wherein the sewing head is moveably connected to the at least one long rail allowing movement of the sewing head through a long axis of the at least one long rail.

7. The apparatus according to claim 6, wherein rotation of the sewing head is substantially prevented by the railing system.

8. The apparatus according to claim 6, wherein the sewing head is moveable by the railing system throughout the support surface.

* * * * *